US007036338B2

(12) United States Patent
Hofer et al.

(10) Patent No.: US 7,036,338 B2
(45) Date of Patent: May 2, 2006

(54) STRING OF BEADS

(75) Inventors: Bernhard Hofer, Telfes (AT); Thomas Brunner, Schwaz (AT)

(73) Assignee: D. Swarovski & Co., Wattens (AT)

( * ) Notice: Subject to any disclaimer, the term of this patent is extended or adjusted under 35 U.S.C. 154(b) by 0 days.

(21) Appl. No.: 10/740,419

(22) Filed: Dec. 22, 2003

(65) Prior Publication Data

US 2004/0129023 A1 Jul. 8, 2004

(30) Foreign Application Priority Data

Dec. 23, 2002 (AT) ..... GM868/2002

(51) Int. Cl.
*A44C 5/00* (2006.01)

(52) U.S. Cl. ..... 63/3; 63/4; 63/38; 59/2; 59/82; 59/90; 29/896.411

(58) Field of Classification Search ..... 63/38, 63/39, 33, 3, 3.1, 4, 5.1, 11; 59/2, 80, 82
See application file for complete search history.

(56) References Cited

U.S. PATENT DOCUMENTS

| | | | | | |
|---|---|---|---|---|---|
| 61,777 | A * | 2/1867 | Wallace | 63/39 |
| 878,122 | A * | 2/1908 | Costello | 63/38 |
| 1,428,348 | A | 9/1922 | Weiss | |
| 1,958,841 | A * | 5/1934 | Bateholts | 63/38 |
| 2,681,545 | A * | 6/1954 | Hall | 59/80 |
| 2,714,269 | A * | 8/1955 | Charles | 59/80 |
| 3,091,030 | A * | 5/1963 | Zumbrunnen | 29/460 |
| 3,192,738 | A * | 7/1965 | Charles et al. | 63/39 |
| 3,303,539 | A * | 2/1967 | White | 63/3 |
| 3,357,204 | A * | 12/1967 | Davis | 63/39 |
| 3,385,050 | A | 5/1968 | Hall | |
| 3,386,240 | A * | 6/1968 | Blumstein | 59/78 |
| RE29,574 | E * | 3/1978 | Pethick et al. | 273/446 |
| 5,117,893 | A * | 6/1992 | Morrison et al. | 160/291 |
| 6,023,946 | A * | 2/2000 | Magi | 63/9 |
| 6,109,999 | A * | 8/2000 | Kuo | 446/236 |
| 6,220,010 | B1 * | 4/2001 | Gomez | 59/80 |
| 6,477,861 | B1 * | 11/2002 | Pottick | 63/3 |
| 6,557,376 | B1 * | 5/2003 | Pratt | 63/3 |
| 6,612,130 | B1 * | 9/2003 | Ito | 63/3 |
| 2001/0055205 | A1 * | 12/2001 | Kamara | 362/104 |

FOREIGN PATENT DOCUMENTS

| | | |
|---|---|---|
| DE | 10 43 685 | 11/1958 |
| DE | 2960422 U1 | 9/1996 |
| DE | 299 13 288 | 10/1999 |
| FR | 1 181 821 | 6/1959 |
| GB | 14674 | 12/1910 |

* cited by examiner

*Primary Examiner*—Jack W. Lavinder
(74) *Attorney, Agent, or Firm*—Wenderoth, Lind & Ponack, L.L.P.

(57) ABSTRACT

A string of beads with deformable connecting pieces which extend between each pair of adjacent beads and which are secured to the beads, wherein the connecting pieces are plastics threads or flexible wires.

8 Claims, 1 Drawing Sheet

STRING OF BEADS

BACKGROUND OF THE INVENTION

1. Field of the Invention

Figure 1:
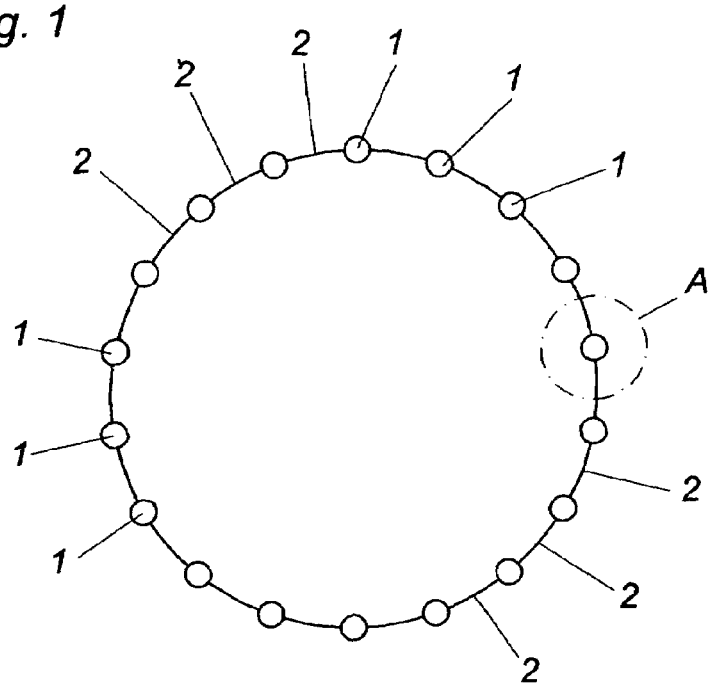

The present invention relates to a string of beads with deformable connecting pieces which extend between each pair of adjacent beads and which are secured to the beads.

2. Description of the Related Art

Such strings of beads are made up of a large number of bead-connecting piece units and can be produced in any desired lengths. The length is always a multiple of the bead-connecting piece unit. Another advantage of these strings of beads is that they do not have to be tied.

However, the joint between the beads and the connecting pieces is problematic in the state of the art. A solution became known from GB 750 737, in which short, rigid connecting pieces with spherical ends engage positively in recesses of the adjacent beads. However, this kind of joint becomes detached under the action of quite severe tensile loading, and as a result, the string of beads can be lost. Furthermore, the length of the rigid connecting pieces is limited, because otherwise the string of beads takes on a polygonal shape and no longer adapts itself elegantly around the wearer's neck.

In U.S. Pat. No. 6,053,009, the connecting pieces all consist of a multilink chain, which is fixed on two adjacent points of the beads by means of intermediate pins. The connecting pieces in the form of a chain can in this way be made up in any length, but joining to the beads via intermediate pins involves a high production expense.

SUMMARY OF THE INVENTION

The object of the present invention is therefore to provide a technologically simple variant of connecting pieces, wherein the connecting pieces at the same time ensure an elegant, circular course of the string.

The above-described object is achieved by the present invention by providing connecting pieces which are plastics threads or flexible wires.

On the one hand, the plastics threads or flexible wires are sufficiently rigid to be inserted directly in openings in the beads so as to be locked there. At the same time, both plastics threads and flexible wires have sufficient flexibility, and therefore, the connecting pieces and thus the string of beads as a whole rest optimally on the wearer's body.

Sufficient stiffness for insertion into the beads plus high flexibility are achieved in particular with nylon threads as connecting pieces.

From the standpoint of production technology, it is particularly simple if the connecting pieces are exclusively glued into the beads, where UV adhesives have proved to be particularly suitable as the adhesive.

It is advantageous if the connecting pieces are glued to one another in the beads. Even if the glued joint between the connecting pieces and the respective bead comes apart, the direct joining of the connecting pieces still gives a closed string, which does not become lost. The only negative consequence is slipping of the beads relative to the connecting pieces.

These and other features, aspects and advantages of the present invention will become more apparent from the following detailed description of the present invention when taken in conjunction with the accompanying drawings.

Figure 2:
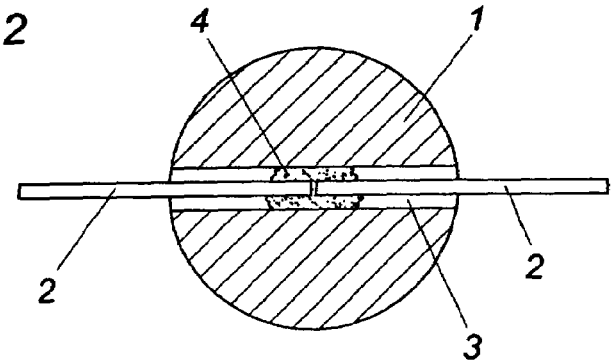
Figure 3:
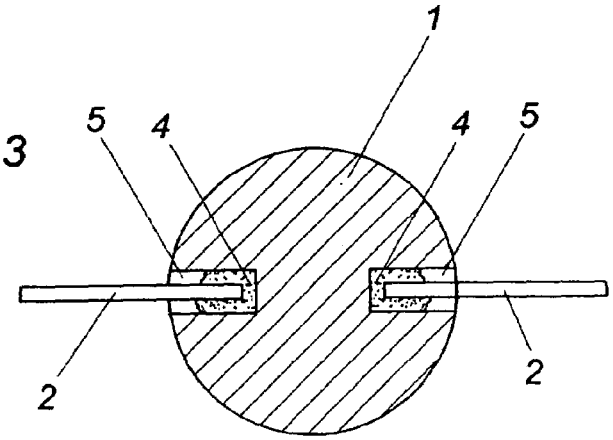

FIG. 1 shows a representation of a string of beads according to the invention, FIG. 2 shows detail A in FIG. 1 with cut beads, and FIG. 3 shows detail A in FIG. 1 of a second variant.

DETAILED DESCRIPTION OF THE INVENTION

The string of beads according to the present invention consists, according to FIG. 1, of a large number of beads 1, with the term "bead" being broadly defined. The term "bead" can refer both to real pearls, as well as glass or plastics beads, whose surface may or may not be processed, for example polished. The color and shape of the beads 1 is also independent of the object of the present invention. In each case, connecting pieces 2 are arranged between the beads 1, and are locked in the contiguous beads 1. The string of beads is thus made up overall of a large number of bead-connecting piece units.

The locking of the connecting pieces 2 is shown in detail in FIG. 2.

The connecting pieces are either plastics threads or flexible wires. The use of nylon threads as the connecting pieces 2 is preferred. Flexibility of the wires can also be achieved by spring-coiling of the wires.

As shown in FIG. 2, the beads 1 have a through hole 3 having a diameter somewhat greater than the diameter of the connecting pieces 2 which are formed from nylon threads. Before inserting the connecting pieces 2 into the through hole 3, an adhesive 4 is placed in the through hole 3 of the bead 1. Single-component adhesives, which harden under the action of UV light or heat, have proved to be suitable, and other adhesives are also suitable.

Then, a connecting piece 2 is inserted from both sides of the bead 1 into the through hole 3, with the connecting pieces 2 forming a butt joint with one another and with the bead 1.

An alternative version of the present invention is shown in FIG. 3, in which the bead 1 has two blind holes 5 instead of the through hole 3. A connecting piece 2 is glued into each of these blind holes 5 by means of the adhesive 4.

The invention claimed is:

1. A string of beads having deformable connecting pieces, wherein each connecting piece extends between and is secured to a pair of adjacent beads, wherein said connecting pieces are at least one of plastic threads and flexible wires, and wherein each one of said connecting pieces is glued to another connecting piece so as to form a butt joint.

2. A string of beads according to claim 1, wherein each of said beads have through holes in which said connecting pieces are secured.

3. A string of beads according to claim 2, wherein said connecting pieces are glued to one another in said beads.

4. A string of beads according to claim 1, wherein said connecting pieces are nylon threads.

5. A string of beads according to claim 1, wherein said connecting pieces are secured to said beads by an adhesive.

6. A string of beads according to claim 5, wherein the adhesive is a UV adhesive.

7. A string of beads according to claim 1, wherein said connecting pieces are glued into said beads.

8. A string of beads according to claim 1, wherein said connecting pieces are each uniformly elastically deformable.

* * * * *